US010290988B2

(12) United States Patent
Judkins et al.

(10) Patent No.: US 10,290,988 B2
(45) Date of Patent: May 14, 2019

(54) ELECTRICAL PLUG

(71) Applicant: Made In Mind Ltd, London (GB)

(72) Inventors: Matthew Judkins, London (GB); Min-Kyu Choi, London (GB)

(73) Assignee: Made in Mind Ltd, London (GB)

( * ) Notice: Subject to any disclaimer, the term of this patent is extended or adjusted under 35 U.S.C. 154(b) by 0 days.

(21) Appl. No.: 15/547,129

(22) PCT Filed: Jan. 29, 2016

(86) PCT No.: PCT/EP2016/051983
§ 371 (c)(1),
(2) Date: Jul. 28, 2017

(87) PCT Pub. No.: WO2016/120474
PCT Pub. Date: Aug. 4, 2016

(65) Prior Publication Data

US 2018/0013250 A1 Jan. 11, 2018

(30) Foreign Application Priority Data

Jan. 29, 2015 (GB) ..... 1501522.5

(51) Int. Cl.
*H01R 31/06* (2006.01)
*H01R 13/66* (2006.01)
(Continued)

(52) U.S. Cl.
CPC ..... *H01R 31/065* (2013.01); *H01R 13/6675* (2013.01); *H01R 24/28* (2013.01);
(Continued)

(58) Field of Classification Search
CPC .. H01R 31/06; H01R 31/065; H01R 2103/00; H01R 24/28; H01R 13/6675;
(Continued)

(56) References Cited

U.S. PATENT DOCUMENTS 4,191,917 A * 3/1980 Brown ..... H01M 10/46 307/150
7,265,517 B2 * 9/2007 Bumiller ..... H01R 13/6675 320/111
(Continued)

FOREIGN PATENT DOCUMENTS

WO 0008725 A1 2/2000

OTHER PUBLICATIONS

PCT Search Report and Written Opinion for PCT Application No. PCT/EP2016/051983 dated Apr. 7, 2016, 11 pages.

*Primary Examiner* — Truc T Nguyen
(74) *Attorney, Agent, or Firm* — Finch & Maloney PLLC

(57) ABSTRACT

An electrical plug comprising: a socket part (5*a*, 5*b*, 5*c*, 5*d*) having a plurality of electrical plugs configured for directly or indirectly plugging into a mains electrical socket; a device part (3) having at least one power output configured for direct or indirect coupling to an electrical device; wherein the socket part is separate and releasable from the device part, and the socket part and device part comprise respective parts of two two-part engagement formations that are engageable to physically and electrically couple the socket part to the device part.

16 Claims, 5 Drawing Sheets

(51) Int. Cl.

| | |
|---|---|
| ***H01R 27/00*** | (2006.01) |
| ***H01R 24/28*** | (2011.01) |
| *H01R 13/502* | (2006.01) |
| *H01R 24/68* | (2011.01) |

(52) U.S. Cl.
CPC ..... *H01R 27/00* (2013.01); *H01R 13/502* (2013.01); *H01R 24/68* (2013.01)

(58) Field of Classification Search
CPC .... H01R 35/04; H01R 24/60; H01R 13/6683; H01R 2107/00; H01R 25/00; H01R 13/516; H01R 13/642; H01R 13/6588; H01R 13/6691
See application file for complete search history.

(56) References Cited

U.S. PATENT DOCUMENTS 7,573,159 B1 8/2009 Deluliis et al.
7,753,721 B1 * 7/2010 Wu ..... H01R 13/6275 431/131
2007/0047182 A1 3/2007 Hassend et al.
2008/0293271 A1 * 11/2008 Zhuge ..... H01R 13/4534 439/139
2009/0117765 A1 * 5/2009 Wen ..... H01R 13/514 439/166
2010/0291786 A1 * 11/2010 Hopwood ..... H01R 13/6273 439/345
2011/0039435 A1 * 2/2011 Huang ..... H01R 27/00 439/218
2012/0021615 A1 * 1/2012 Wen ..... H01R 31/065 439/13
2013/0076298 A1 3/2013 Miller et al.
2013/0094154 A1 * 4/2013 Shen ..... H01R 13/502 361/731
2013/0157483 A1 6/2013 Yu et al.
2013/0307464 A1 11/2013 Zhu
2014/0199871 A1 * 7/2014 Liu ..... H01R 31/065 439/312
2015/0064955 A1 * 3/2015 Liu ..... H01R 24/68 439/344

* cited by examiner

ELECTRICAL PLUG

RELATED APPLICATIONS

This application claims priority under 35 U.S.C. § 371 as a national stage application of PCT Application No. PCT/EP2016/051983, filed Jan. 29, 2016, which claims priority to GB 1501522.5, filed Jan. 29, 2015, each of which is hereby incorporated herein by reference in its entirety.

FIELD

In one aspect, this invention relates to electrical plugs, in particular electrical plugs that are suitable for inserting into a mains electrical socket for the supply of power from the socket to an appliance. The mains electrical socket may comprise an outlet that is directly coupled to a ring main, or indeed an outlet on an extension lead (which lead is coupled to an outlet on the ring main). In another aspect, this invention relates to an electrical power supply system comprising a plurality of parts that can be assembled to form various electrical plugs that differ either in terms of socket pin configuration, power output or both.

BACKGROUND

We have previously disclosed a novel folding plug (see www.themu.co.uk and UK Patent No. 2467644) that is greatly reduced in size in comparison to a traditional three-pin plug of the type that may be plugged into mains socket outlets of the type that are common in the United Kingdom.

Whilst this arrangement greatly reduces the size of such plugs, it would be useful if a greater range of devices could be powered by such an arrangement.

It would also be useful if the compact nature of our previously proposed Mu adaptor could be applied to plugs that are configured for plugging into other types of mains electrical socket. Lastly, it would be particularly useful if a system could be devised that allowed a greater range of devices to be powered, and which provided compact plugs for plugging into other types of mains electrical socket.

Our co-pending UK and International applications (GB1416882.7 and PCT/EP2014/070418, the contents of each of which are incorporated herein (in their entirety) by reference) disclose a power supply system that has been devised with the foregoing problems in mind. In very general terms, this system comprises a plurality of socket parts and a plurality of device parts, and the socket parts can interchangeably be coupled to device parts to provide the user with a desired pin configuration and power output combination. The teachings of the invention disclosed in these application is also applicable to a given socket part that can interchangeably be coupled to different device parts, thereby providing the user with a desired power output for a given pin configuration.

Whilst the arrangements disclosed in these co-pending applications functions admirably, the applicant's continuous program of improvement has identified that the coupling between the aforementioned socket and device parts could be further enhanced. The present invention has been devised with the foregoing in mind.

SUMMARY

In accordance with a presently preferred embodiment of the present invention, there is provided an electrical plug comprising: a socket part having a plurality of electrical plugs configured for directly or indirectly plugging into a mains electrical socket; a device part having at least one power output configured for direct or indirect coupling to an electrical device; wherein the socket part is separate and releasable from the device part, and the socket part and device part comprise respective parts of two two-part engagement formations that are engageable to physically and electrically couple the socket part to the device part.

The first two-part engagement mechanism may include a projecting part and a recess in which the projecting part may be received. The second two-part engagement mechanism may include a projecting part and a recess in which the projecting part may be received.

Preferably at least part of said projecting part has a shape that is complementary to at least part of said recess.

The recess may include a first region in which said projecting part may freely be withdrawn from said recess in a first direction that separates the socket and device parts, and a second region configured to resist separation of the device and socket parts in said direction. In one implementation, the projecting part can be moved between said first and second regions by sliding said device part relative to said socket part or said socket part relative to device part in a second direction generally transverse to said first direction.

In one embodiment, at least part of said projecting part is generally T-shaped in cross-section, and said second region of said recess is generally T-shaped in cross-section. In another embodiment, at least part of said projecting part is generally L-shaped in cross-section, and said second region of said recess is generally L-shaped in cross-section.

The projecting part of the first two-part engagement mechanism may be on one of the socket part and the device part, and the projecting part of the second two-part engagement mechanism may be on the other of the socket part and the device part. In another arrangement, the projecting part of the first two-part engagement mechanism and the projecting part of the second two-part engagement mechanism may be on the socket part or the device part.

In a preferred embodiment, one said projecting part includes a pair of electrical contacts engageable with cooperating electrical contacts provided in the recess associated with said projecting part to electrically couple the socket part to the device part. Preferably, the projecting part contacts are buried within the body of the projecting part. In one implementation, access to said contacts may be provided by means of slots in a face of said projecting part that permit entry to the electrical contacts in the recess but nevertheless shield a user from contact with the electrical contacts in said projecting part.

At least one of said socket part and said device part may include a store for electrical energy and a store controller. The store may comprise a capacitor or a rechargeable battery. The store controller may comprise logic configured to ascertain whether the device part is coupled to a socket part and/or whether pins of the socket part are plugged into a socket, and whether an electrical device is coupled to said device part. The logic may be configured to direct electrical power from said store to a device connected to said device part if the device part is not connected to a socket part or the connected device and socket parts are not plugged into a socket.

The logic may be configured to direct electrical power to said store if the device part is connected to a socket part, the connected device and socket parts are plugged into a socket, and the device part is not connected to an electrical device.

The store controller may comprise a smart controller operable, as required, to direct power from a socket to said electrical store, to output power from said store to a device coupled to said device part when said socket part is not drawing power from a socket into which it is plugged, and to direct power to both said store and a device coupled to said device part when said socket part is drawing power from a socket into which it is plugged.

The socket part may be one of a plurality of socket parts, each socket part having a different pin configuration suitable for plugging into an associated electrical socket. The device part may be one of a plurality of device parts, each device part having a different number and/or type of power outputs.

Another aspect provides a power supply system comprising a socket part and a plurality of device parts, said socket part being selectively couplable to each of said device parts to form an electrical plug; the socket part and each said device part comprising respective parts of two two-part engagement formations that are engageable to physically and electrically couple the socket part to a selected device part.

A further aspect provides a power supply system comprising a device part and a plurality of socket parts, said device part being selectively couplable to each of said socket parts to form an electrical plug; the device part and each said socket part comprising respective parts of two two-part engagement formations that are engageable to physically and electrically couple the device part to a selected socket part.

Other features, aspects, embodiments and advantages thereof are set out hereafter in the accompanying detailed description.

BRIEF DESCRIPTION OF THE DRAWINGS

Various aspects of the teachings of the present invention, and arrangements embodying those teachings, will hereafter be described by way of illustrative example with reference to the accompanying drawings, in which.

DETAILED DESCRIPTION

Figure 1:
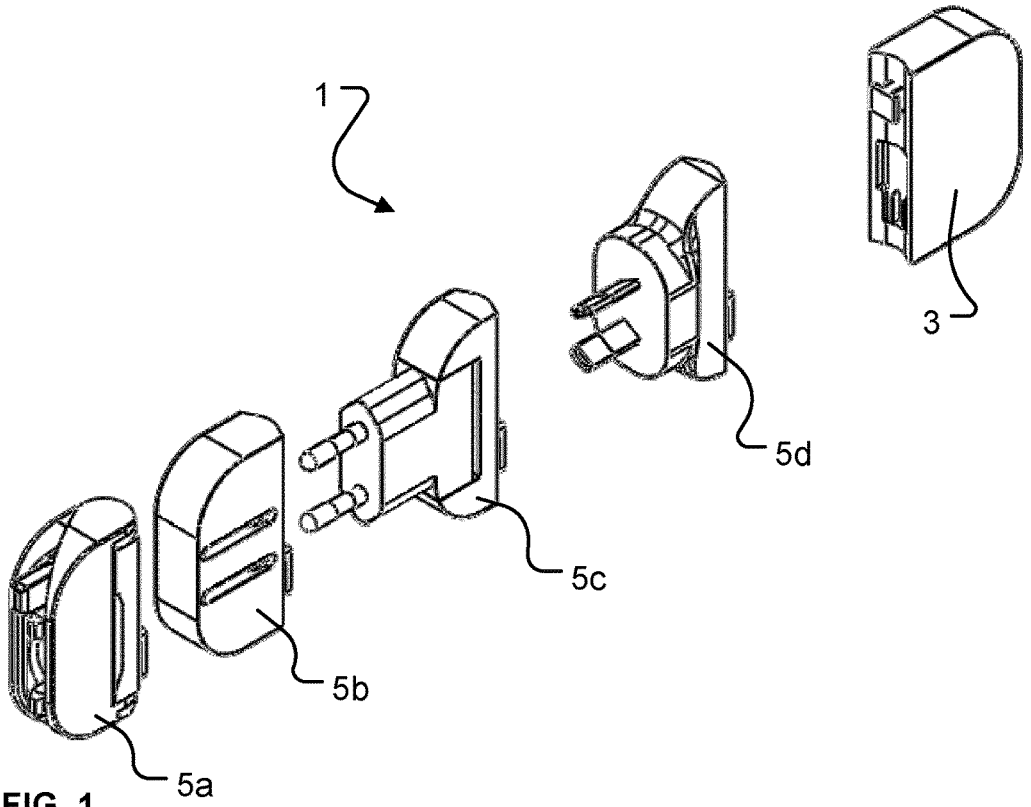
FIG. 1 is a schematic representation of a power supply system similar to that disclosed in the aforementioned co-pending UK and PCT patent applications.

FIG. 1 is a schematic representation of a power supply system 1 similar to that disclosed in the aforementioned pending UK and PCT patent applications. As shown, the power supply system 1 comprises, in this particular example, a device part 3 that can selectively be coupled to any of a selection of socket parts 5*a* to 5*d*—the device part 3 and selected socket part 5 together forming an electrical plug for coupling to an electrical socket with a pin configuration matching that of the socket part 5.

In another configuration, the system may comprise a single socket part 5 appropriate for the mains electrical socket of the country in which the system is to be used, and a plurality of device parts 3 with different power outputs or power output configurations (such as different numbers, types or configurations of power output sockets). Another system configuration comprises a plurality of socket parts 5 and a plurality of device parts 3, thereby enabling the user to select the most appropriate socket part pin configuration and power output configuration for the country in which the system is to be used and the device with which the electrical plug is to be used. Another aspect of the present invention relates to an electrical plug that comprises a single socket part and a single device part, such a plug being particular compact and thus easy to transport.

Figure 2:
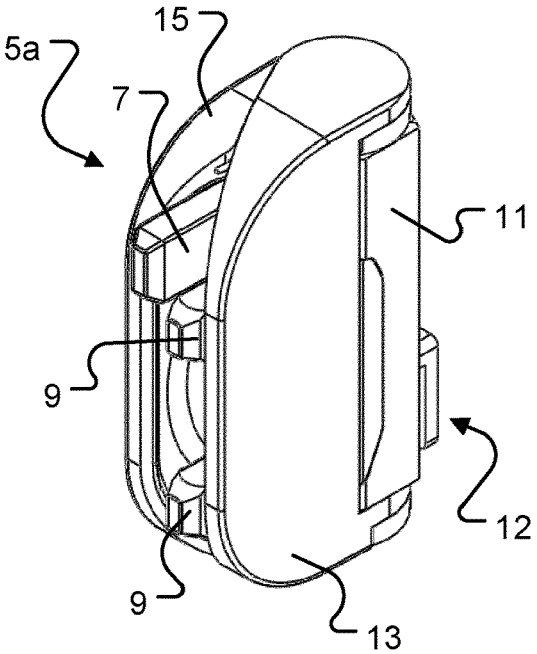
FIG. 2 is a front perspective view of a UK configuration socket part.

In the particular arrangement depicted in FIG. 1, socket part 5*a* is configured for use with mains electrical sockets of the type commonly used in the United Kingdom (and elsewhere). Socket part 5*a* resembles (and functions substantially in the same way as) the Mu plug that is described in more detail in United Kingdom Patent No. 2467644 (the entire contents of which is incorporated herein by reference). As shown in FIG. 2, socket part 5*a* comprises three pins, a longer earth pin 7, and two shorter pins 9 that connect the plug to the live and neutral mains supply (respectively). The two shorter pins are mounted on an arm that is rotatable between a storage position (shown) where the arm is parallel to a main body 11 of the socket part and the three pins are generally linearly aligned, and an operative position (shown in GB2467644, see FIG. 28 in particular) where the arm is perpendicular (at least substantially) to the main body of the socket part and the three pins are located at respective apexes of a triangle (i.e. so that the pins are configured for plugging into a UK style electrical plug).

First and second wings 13, 15 are pivotally mounted to the device part main body 11, and (at least substantially) cover the three pins 7, 9 when they lie parallel to the device part main body (as shown in FIG. 2). In this position the wings are in their storage position. To move the arm from the aforementioned storage position to the operative position, the wings must first be pivoted to their operative position, namely a position (depicted in FIG. 28 of GB2467644) where they extend roughly perpendicularly from the main body of the device part. Once the wings have been pivoted to their operative position, the arm can be pivoted to its operative position and the socket part can now be plugged into a socket. Advantageously, the wings cannot be pivoted further away from the pins than their operative position, and thus obstruct access to the pins of the socket part when the socket part is plugged into a socket.

As will be explained in more detail below, the socket part main body includes a device part interface 12 that is configured to couple to a complementary interface of a device part.

Figure 3:
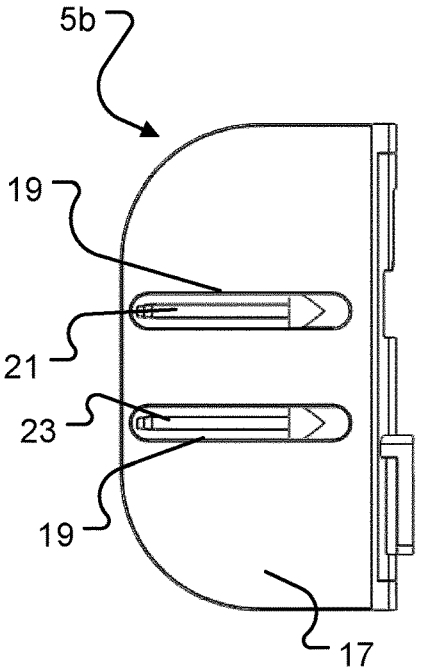
FIG. 3 is a side elevation of a USA configuration socket part.

FIG. 3 is a side elevation of another socket part, in this instance a socket part 5*b* that is configured for plugging into electrical sockets of the type that are commonly found in the United States of America (and elsewhere). The socket part comprises a main body 17 in which a pair of elongate parallel recesses 19 are formed. First and second electrical pins 21, 23 are mounted in respective recesses 19 and can be pivoted from a storage position (as shown) where the pins are stored within the recess, to an operative position (not shown) where the pins extend—for example generally perpendicularly—from the main body 17.

Figure 4:
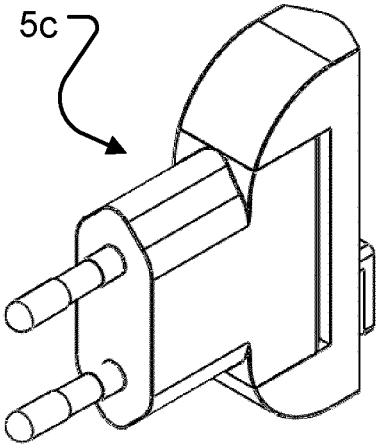
FIG. 4 is a front perspective view of an EU configuration socket part.
Figure 5:
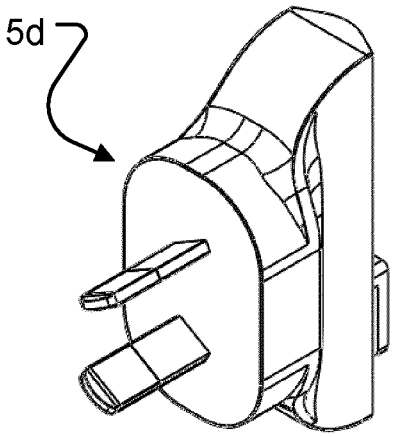
FIG. 5 is a front perspective view of an AU configuration socket part.

FIG. 4 shows a socket part 5*c* with a configuration that is suitable for use with electrical sockets of the type that is commonly used throughout mainland Europe, and FIG. 5 shows a socket part 5*d* of the type that is commonly in Australia.

Figure 6:
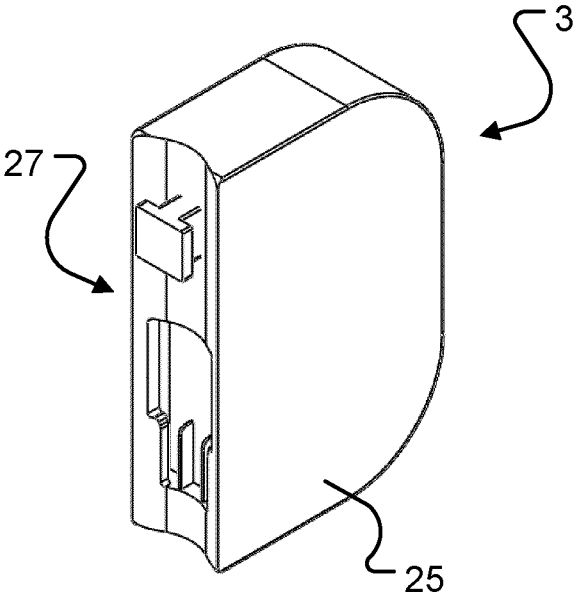
FIG. 6 is a front perspective view of an illustrative device part.
Figure 7:
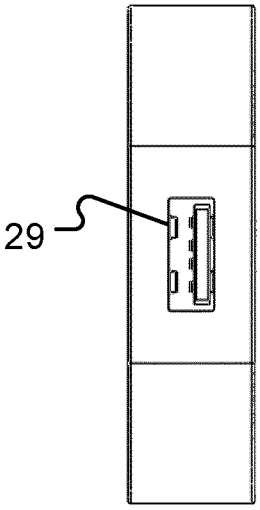
FIG. 7 is a rear elevation of the device part depicted in FIG. 6.

Each of the aforementioned socket parts is configured, as mentioned above, so as to be capable of being selectively coupled to, and decoupled from, a device part—for example a device part 3 of the type shown in FIG. 1. Such a device part, shown in more detail in FIG. 6, comprises a main body 25 that includes a socket part interface 27 (configured to mate with the device part interface of a device part), and on its opposite face, a power outlet 29 (FIG. 7). In this instance the power outlet comprises a USB-compatible port, but it will be appreciated that any type of power outlet could in principle be provided. It will also be appreciated that several power outlets could be provided, thereby enabling more than one device to be charged from one electrical plug.

As will be appreciated by those persons of ordinary skill in the art, the device part main body 25 houses conventional electrical components that are configured to step-down mains voltage to a voltage appropriate for the device that is to be plugged into the power outlet 29. Since such components are well known to persons of ordinary skill in the art, they will not be described in detail herein.

Figure 10:
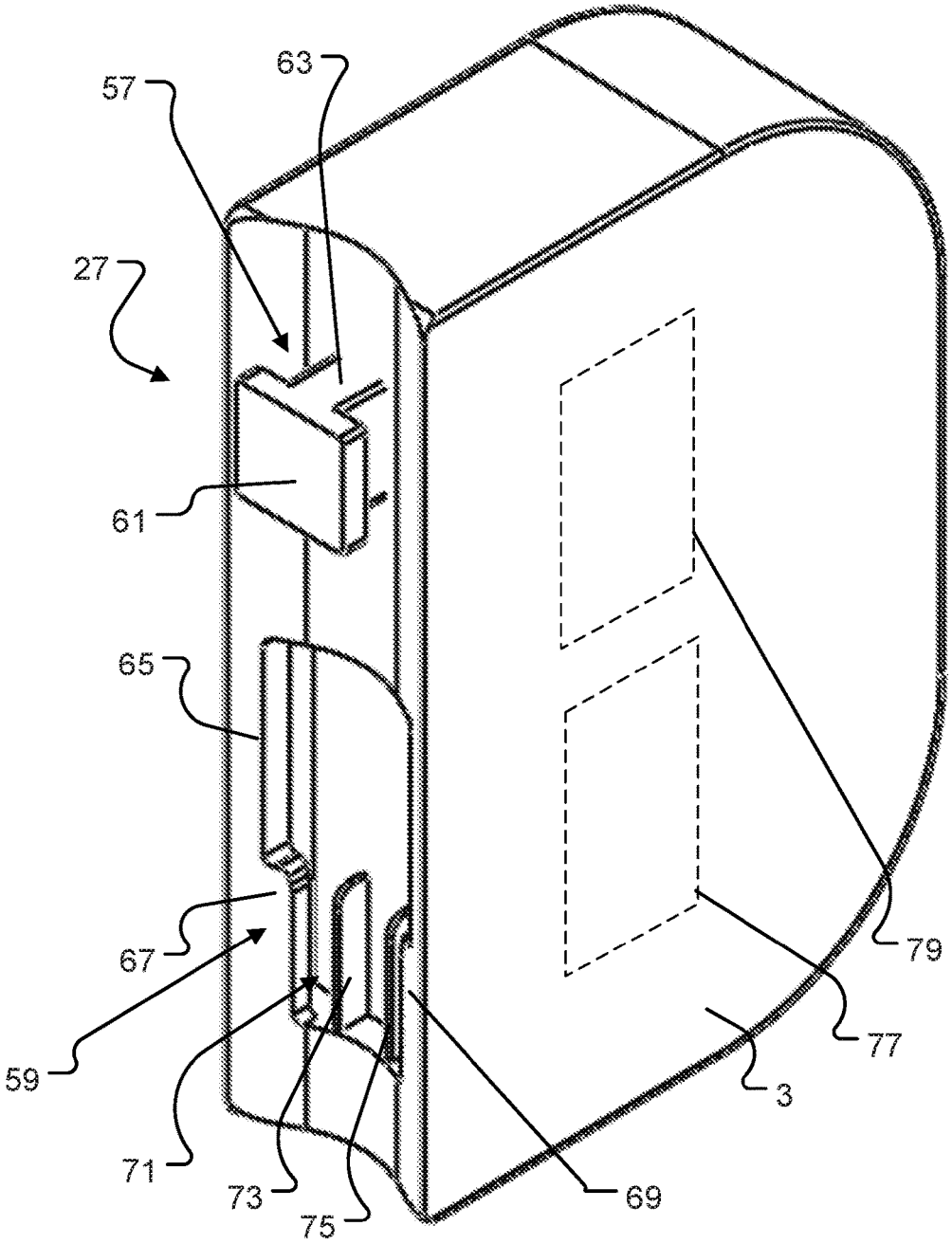
FIG. 10 is a front perspective view of an illustrative device part.

In addition to the aforementioned electrical components, it is also envisaged to incorporate, within the device part main body (and/or, optionally, within the socket part main body), a store for electrical energy 77 (FIG. 10) and a store controller 79 (FIG. 10). The store for electrical energy may comprise a capacitor, a rechargeable battery or any other device for storing electrical energy. The store controller comprises logic that is configured to ascertain whether the device part is coupled to a socket part, and/or whether pins of the socket part of the electrical plug are plugged into a socket, whether a connector is plugged into power outlet 29, and to direct electrical power to or from the electrical energy store as appropriate. For example, the controller may determine that the pins of the socket part are plugged into a powered socket when a voltage difference is detected between the pins, and that a connector is plugged into the outlet when power is drawn through that connector.

In one configuration, if the controller determines that the pins of the socket part of the electrical plug are plugged into a socket and a connector is plugged into the power outlet, then the controller allows power to flow from the pins of the plug to an appliance connected to the power outlet. If the controller should determine that the pins of the socket part are plugged into a socket, and no connector is plugged into the outlet then the controller diverts electrical power to the energy store. Finally, if the controller should determine that a connector is plugged into the power outlet, but the pins of the socket part are not plugged into a socket, then the controller allows electrical energy to flow from the electrical store and to an appliance via the power outlet.

As will be appreciated, with this arrangement a user is provided with a source of electrical power than can be used (for example, to recharge an appliance) even though the user is not able to plug the plug into an electrical socket, and all without the user having to carry a separate source of electrical power in addition to a charger.

In another envisaged arrangement, the controller may be a so-called smart controller (the like of which is known to persons of ordinary skill in the art) that is able to direct power from a socket (into which the socket part of the plug is plugged) to an appliance coupled to the plug via the power outlet, and divert any excess power to the electrical store—the amount diverted being varied in accordance with the power drawn by the appliance to which the plug is connected.

Figure 8:
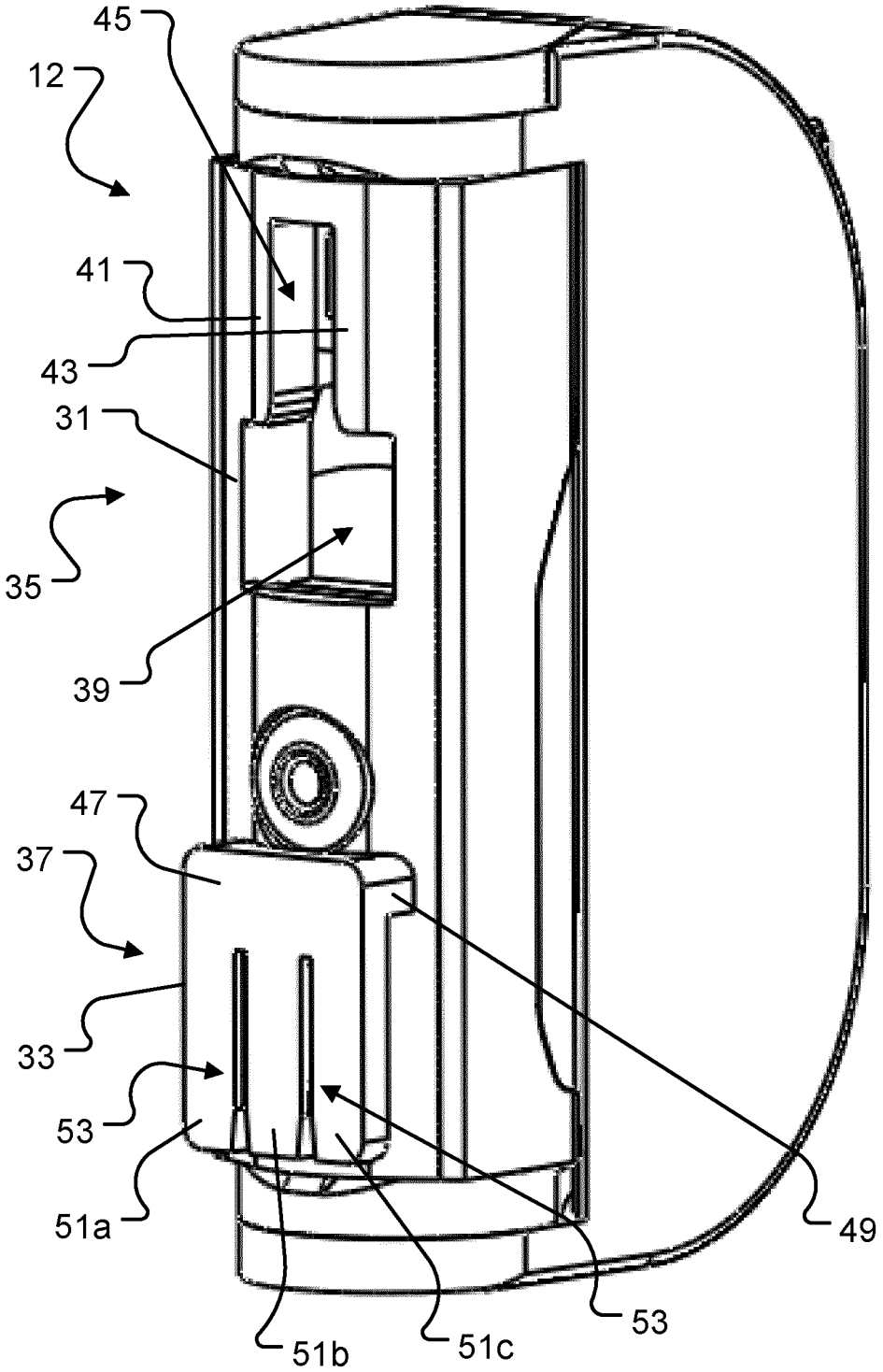
FIG. 8 is a rear perspective view of a UK configuration socket part.

Referring now to FIGS. 8 and 10 of the drawings, there are shown (respectively) perspective views of the device part interface 12 on a socket part (in this particular example, socket part 5*a*), and the socket part interface 27 on a device part 3. These interfaces are complementary to one another so that device and socket parts can be coupled to one another.

In general terms, the device part interface 12 and the socket part interface 27 each comprise first and second two-part engagement formations, with the parts of each formation being complementary. The provision of two such formations enhances the strength of the coupling between the respective parts, thereby reducing the likelihood of damage occurring if the join between the parts should be put under stress (as may happen, for example, if someone should accidentally knock against the device part of the plug when the socket part is plugged into a mains electrical socket). Providing the aforementioned formations towards respective peripheries of the two parts also helps reduce the incidence of breakages caused by attempts to rotate the device part relative to the socket part when the socket part is plugged into a mains electrical socket.

Referring to FIG. 8, the device part interface 12 comprises first parts 31, 33 of a first 35 and a second 37 two-part engagement formation. The first part 31 of the first engagement formation comprises a recess 39. A pair of flanges 41; 43 extend over part of the recess to form a slot 45 and define a void between the underside of each flange and the base of the recess. As will be appreciated, the voids and slot together form a space within the recess that is generally T-shaped in cross-section.

Figure 9:
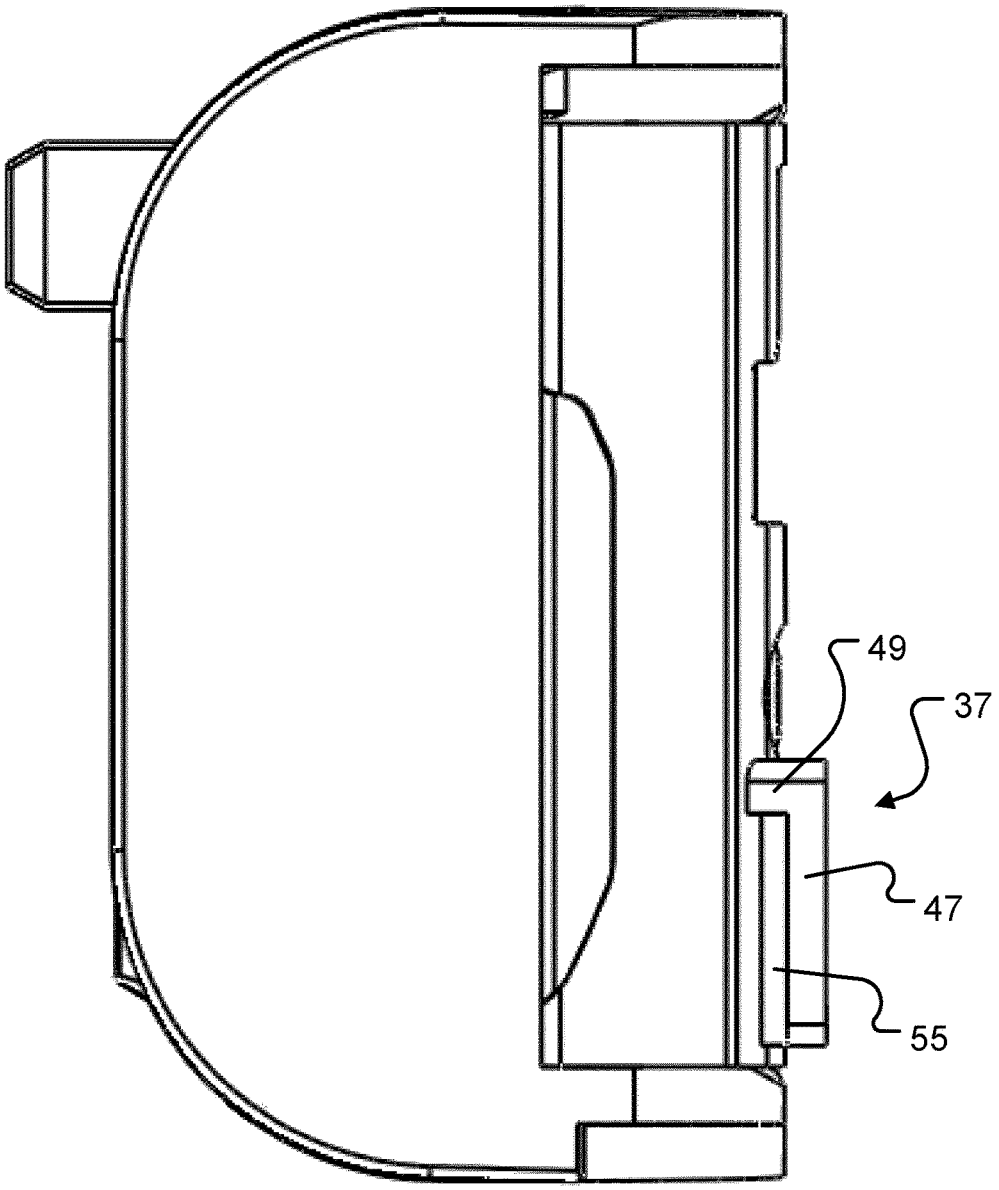
FIG. 9 is a side elevation of the socket part shown in FIG. 8.

The first part 33 of the second two part engagement formation 37 comprises a generally rectangular plate 47 that extends towards the periphery of the socket part from a wall 49 that projects generally perpendicularly from the socket part main body. Part of the rectangular plate 47 is subdivided into three prongs 51*a*, 51*b* and 51*c* by a pair of grooves 53, and the second 51*b* of these three prongs is supported by a wall 55 (FIG. 9) extending generally perpendicularly from the socket part main body (and perpendicularly from wall 49). As a result of this configuration, at least the sub-divided part of the first part 33 of the second two part formation 37 is generally T-shaped in cross-section. The first part 33 of the second two part engagement formation also includes a pair of electrical contacts (not visible) buried within the rectangular plate 47, each being accessible via a respective one of the aforementioned grooves 53.

Referring now to FIG. 10, the socket part interface 27 comprises second parts 57, 59 of the aforementioned first 35 and second 37 two-part engagement formations.

The second part 57 of the first two-part engagement formation comprises a plate 61 that is sized so as to be insertable into the open part of the recess 33 (i.e. that part over which the flanges 41, 43 do not extend), and the plate 61 is spaced from the device part main body by a wall 63 (the wall being sized so as to be slideably receivable within the slot 45) that extends generally perpendicularly from the device part main body. As can be seen in FIG. 10, the plate 61 and wall 63 together define a body that is generally T-shaped in cross section.

The second part 59 of the second two-part engagement formation comprises a recess 65, and a pair of flanges 67; 69 extend over part of the recess 65 to form a narrowed entrance 71 to the recess. The flanges 67, 69 define a void between the underside of each flange and the base of the recess. As will be appreciated, the voids and the narrowed entrance together form a space within the recess that is generally T-shaped in cross-section. That part of the recess not partly covered by the flanges (referred to hereafter as the open part) is sized so as to accept the rectangular plate 47 of the first part 33 of the second two-part engagement formation A pair of electrical contacts 73, 75 project from a sidewall of the recess 65, and comprise plates that are sized and arranged so as to be slideably receivable in respective grooves 53 in the rectangular plate 47 of the first part 33 of the second two-part engagement formation.

To couple the device part to the socket part (and thereby form an electrical plug that can be plugged into a socket), the plate 61 of the second part 57 of the first engagement formation 31 is aligned with the open part of the recess 39 of the first part of the first engagement formation 33; and the plate 47 of the first part 33 of the second engagement formation 37 is aligned with the open part of the recess 65 of the second part 59 of the second engagement formation 33. The device part and socket part are then pushed together whereupon plate 61 enters the open part of recess 39 and plate 47 enters the open part of recess 65.

Moving the device part laterally with respect to the socket part causes wall 63 to move through slot 45 until the lateral peripheral parts of plate 61 locate beneath flanges 41, 43. Simultaneously, plate 47 moves beneath flanges 67, 69 and electrical contacts 73, 75 each slide into a respective groove 53 and into electrical contact with the electrical contacts within plate 47.

In this position, the device part is electrically coupled to the socket part, and the device and socket part cannot readily be separated by putting them apart. Furthermore, the provision of two spaced engagement formations increases resistance to rotation of the device part relative to the socket part and thereby reduces the likelihood of the plug being damaged.

It will be appreciated that whilst various aspects and embodiments of the present invention have heretofore been described, the scope of the present invention is not limited to the particular arrangements set out herein and instead extends to encompass all arrangements, and modifications and alterations thereto, which fall within the scope of the appended claims.

For example, whilst the first and second engagement formations each include T-shaped cross-sectional components, it will be appreciated that a working arrangement could be provided with L-shaped cross-sectional components, or indeed one T-shaped two-part engagement formation and one L-shaped engagement formation.

As aforementioned, the present invention contemplates the provision of a two-part electrical plug having a socket part and a device part, and first and second two-part engagement formations of the type described herein. The invention further contemplates the provision of: (i) a power supply system comprising one socket part and a plurality of device parts, (ii) a power supply system comprising one device part and a plurality of socket parts, and (iii) a power supply system comprising a plurality of device parts and a plurality of socket parts. In each of embodiments (i), (ii) and (iii) the socket and device parts include respective parts of two two-part engagement formations. In such systems the socket part(s) and the device part(s) are configured as disclosed herein (irrespective of the device part power outlet configuration or the socket part pin configuration).

Furthermore, whilst in the foregoing embodiment, power transfer occurs via one of the aforementioned engagement formations, it is conceivable for power transfer to occur via both engagement formations. For example, in a United Kingdom configuration, one engagement formation could transfer power from the neutral pin of the socket part and the other could transfer power from the live pin of the socket part. It is also conceivable for the second part 57 of the first two-part engagement mechanism 35 (and the corresponding first part 31 of the first two-part engagement mechanism) to include electrical contacts that can be interconnected to electrically couple the earth pin of the UK style socket part 5*a* to the ring main of the socket that the plug is to be used with.

It should also be noted that whilst in the preferred embodiment both the socket part and the device part each include one projecting part of an engagement formation (in the specific embodiment, socket part 5 includes projecting plate 47, and device part 3 includes projecting plate 61), the projecting parts of the engagement formations could be provided on one of the socket or device part (with the co-operating parts provided on the other).

Lastly, it should also be noted that whilst the accompanying claims set out particular combinations of features described herein, the scope of the present invention is not limited to the particular combinations hereafter claimed, but instead extends to encompass any combination of features herein disclosed.

The invention claimed is:

1. An electrical plug comprising:

a socket part having a plurality of electrical pins configured for directly or indirectly plugging into a mains electrical socket; and a device part having at least one power output configured for direct or indirect coupling to an electrical device;

wherein the socket part is separate and releasable from the device part, and the socket part and device part comprise respective parts of first and second two-part engagement formations that are engageable to physically and electrically couple the socket part to the device part, said first two-part engagement formation including a first projecting part on said socket part and a first recess in said device part in which the first projecting part may be received, and said second two-part engagement formation including a second projecting part and a second recess in which the second projecting part may be received; and the first projecting part comprises a body in which a pair of electrical contacts are buried, said electrical contacts being engageable with cooperating electrical contacts provided in the first recess associated with said first projecting part to electrically couple the socket part to the device part, access to said electrical contacts being provided by slots in a face of said first projecting part that permit entry to said electrical contacts in the first recess but nevertheless shield a user from contact with the electrical contacts in said first projecting part.

2. The electrical plug according to claim 1, wherein at least part of each of said first and second projecting parts has a shape that is complementary to at least part of each of said first and second recesses, respectively.

3. The electrical plug according to claim 2, wherein each of said first and second recesses includes a first region from which each of said first and second projecting parts, respectively, may freely be withdrawn in a first direction that separates the socket and device parts, and a second region configured to resist separation of the device and socket parts in said first direction.

4. The electrical plug according to claim 3, wherein said first and second projecting parts can be moved between said first and second regions by sliding said device part relative to said socket part or said socket part relative to device part in a second direction generally transverse to said first direction.

5. The electrical plug according to claim 4, wherein at least part of said second projecting part is generally T-shaped in cross-section, and said second region of said second recess is generally T-shaped in cross-section.

6. The electrical plug according to claim 4, wherein at least part of said first projecting part is generally L-shaped in cross-section, and said second region of said first recess is generally L-shaped in cross-section.

7. The electrical plug according to claim 1, wherein at least one of said socket part and said device part includes a store for electrical energy and a store controller.

8. The electrical plug according to claim 7, wherein said store controller comprises logic configured to ascertain whether the device part is coupled to the socket part and/or whether pins of the socket part are plugged into the mains electrical socket, and whether the electrical device is coupled to said device part.

9. The electrical plug according to claim 8, wherein said logic is configured to direct electrical power from said store to a device connected to said device part if the device part is not connected to the socket part or the connected device and socket parts are not plugged into the mains electrical socket.

10. The electrical plug according to claim 8, wherein said logic is configured to direct electrical power to said store if the device part is connected to the socket part, the connected device and socket parts are plugged into the mains electrical socket, and the device part is not connected to the electrical device.

11. The electrical plug according to claim 7, wherein said store controller comprises a smart controller operable, as required, to direct power from the mains electrical socket to said electrical store, to output power from said store to a device coupled to said device part when said socket part is not drawing power from the mains electrical socket into which it is plugged, and to direct power to both said store and the device coupled to said device part when said socket part is drawing power from the mains electrical socket into which it is plugged.

12. The electrical plug according to claim 1, wherein either (a) said socket part is one of a plurality of socket parts, each socket part having a different pin configuration suitable for plugging into an associated electrical socket, and/or (b) said device part is one of a plurality of device parts, each device part having a different number and/or type of power outputs.

13. An electrical plug for directly or indirectly connecting an electrical appliance to a mains electrical supply, the electrical plug comprising:

socket body means including electrical pin means protruding from a first face of said socket body means, said electrical pin means being configured and arranged for plugging said socket body means into a mains electrical socket;

device body means including at least one electrical power output means opening to a first face of said device body means, said electrical power output means being configured for coupling the device body means to an electrical appliance to which electrical power is to be supplied;

wherein:

said socket body means is separate and releasably connectable to said device body means, said socket body means includes a second face opposite said first face from which a first part of a first two-part engagement means projects and in which a second part of a second two-part engagement means is provided;

said device body means includes a second face opposite said first face in which a second part of said first two-part engagement means is provided and from which a second part of said second two-part engagement means projects;

said first and second two-part engagement means are engageable with one another to physically couple the socket body means to the device body means with respective second faces adjacent one another;

respective parts of one of said first or second two-part engagement means include electrical contacts for electrically coupling said socket body means to said device body means when the first and second two-part engagement means are engaged, the electrical contacts on said socket body means being shrouded so as to restrict access thereto by a user of said electrical plug;

said socket body means includes internal circuitry to electrically couple the electrical pin means of said socket body means to the shrouded electrical contacts; and said device body means includes internal circuitry to electrically couple the electrical contacts on said device body means to said electrical power output means.

14. The electrical plug according to claim 13, wherein said electrical pin means comprise a pair of electrical pins mounted on an arm that can be rotated between a first position where the arm lies wholly within a peripheral boundary of said socket body means first face and a second position where the arm projects beyond said peripheral boundary.

15. A kit including components of a power supply system for electrically coupling an electrical appliance to mains electrical sockets having differing socket configurations, the kit comprising:

a plurality of socket bodies, each including a set of electrical pins protruding from a first face, each said set of electrical pins having a different configuration for enabling the socket body to which the set is attached to be plugged into a particular type of electrical socket;

a device body including at least one electrical power output opening to a first face of said device body, said electrical power output being configured for coupling the device body to an electrical appliance to which electrical power is to be supplied;

wherein:

each said socket body is separate and releasably connectable to said device body, each said socket body includes a second face opposite said first face from which a first part of a first two-part engagement formation projects and in which a second part of a second two-part engagement formation is provided;

said device body includes a second face opposite said first face in which a second part of said first two-part engagement formation is provided and from which a second part of said second two-part engagement formation projects;

said first and second two-part engagement formations are engageable with one another to physically couple each socket body to the device body with respective second faces adjacent one another;

respective parts of one of said first or second two-part engagement formations include electrical contacts for electrically coupling each said socket body to said device body when the first and second two-part engagement formations are engaged, the electrical contacts on each said socket body being shrouded so as to restrict access thereto by a user;

each said socket body includes internal circuitry to electrically couple the at least some of the set of electrical pins of said socket body to the shrouded electrical contacts; and said device body includes internal circuitry to electrically couple the electrical contacts on said device body to said electrical power output.

16. The kit according to claim 15, wherein one or more of said device body and at least one socket body of said plurality of socket bodies includes a store for electrical energy and a store controller.

* * * * *